US011102864B2

(12) United States Patent
Hsia

(10) Patent No.: US 11,102,864 B2
(45) Date of Patent: Aug. 24, 2021

(54) SOLID-STATE LIGHTING WITH REMOTE TESTS AND CONTROLS

(71) Applicant: Aleddra Inc., Renton, WA (US)

(72) Inventor: Chungho Hsia, Bellevue, WA (US)

(73) Assignee: Aleddra Inc., Renton, WA (US)

( * ) Notice: Subject to any disclaimer, the term of this patent is extended or adjusted under 35 U.S.C. 154(b) by 0 days.

(21) Appl. No.: 16/904,206

(22) Filed: Jun. 17, 2020

(65) Prior Publication Data

US 2020/0323063 A1 Oct. 8, 2020

Related U.S. Application Data

(63) Continuation-in-part of application No. 16/880,375, filed on May 21, 2020, which is a continuation-in-part of application No. 16/861,137, filed on Apr. 28, 2020, now Pat. No. 10,992,161, which is a continuation-in-part of application No. 16/830,198, filed on Mar. 25, 2020, now Pat. No. 10,869,373, which is a continuation-in-part of application No. 16/735,410, filed on Jan. 6, 2020, now Pat. No. 10,660,179, which is a continuation-in-part of application No. 16/694,970, filed on Nov. 25, 2019, now Pat. No. 10,602,597, which is a continuation-in-part of application No. 16/681,740, filed on Nov. 12, 2019, now Pat. No. 10,959,310, (Continued)

(51) Int. Cl.

| | |
|---|---|
| ***H05B 45/382*** | (2020.01) |
| ***H05B 45/37*** | (2020.01) |
| ***F21S 9/02*** | (2006.01) |
| ***H05B 47/19*** | (2020.01) |
| *F21Y 115/10* | (2016.01) |

(52) U.S. Cl.

CPC ..... *H05B 45/37* (2020.01); *F21S 9/022* (2013.01); *H05B 47/19* (2020.01); *F21Y 2115/10* (2016.08)

(58) Field of Classification Search

CPC .. H02J 2207/20; H02J 7/04; H02J 7/00; H02J 7/0031; H02J 7/0048; H02J 7/0068; H02J 7/00714; H02J 9/065; H02J 7/06; H05B 45/37; H05B 45/382; H05B 45/30; H05B 45/31; H05B 45/325; H05B 47/19; Y02B 20/30; F21S 9/022; F21Y 2115/10

See application file for complete search history.

(56) References Cited

U.S. PATENT DOCUMENTS

| | | | | |
|---|---|---|---|---|
| 6,933,627 | B2 * | 8/2005 | Wilhelm | H02J 1/06 307/66 |
| RE42,161 | E * | 2/2011 | Hochstein | H05B 45/355 363/89 |
| 8,823,272 | B2 * | 9/2014 | Trainor | H05B 45/10 315/200 R |

* cited by examiner

*Primary Examiner* — William J Carter
*Assistant Examiner* — Omar Rojas Cadima
(74) *Attorney, Agent, or Firm* — Andy M. Han; Han IP PLLC

(57) ABSTRACT

A light-emitting diode (LED) luminaire control system comprising a rechargeable battery and a control and test circuit is adopted to provide an emergency power to operate a luminaire that works only in alternate-current (AC) mains. The luminaire comprises LED arrays and a power supply. The LED luminaire control system further comprises a current-fed converter circuit, a control and test unit, a relay switch, a local controller, a remote controller, and a receiver circuit. When a battery discharging test is initiated by the remote controller with a band-pass signal transmitted, the receiver circuit can detect such a signal and subsequently send a decoded command to the LED luminaire control (Continued)

system to execute such a test by operating the luminaire without uncertainty.

20 Claims, 4 Drawing Sheets

Related U.S. Application Data which is a continuation-in-part of application No. 16/664,034, filed on Oct. 25, 2019, now Pat. No. 10,660,184, which is a continuation-in-part of application No. 16/572,040, filed on Sep. 16, 2019, now Pat. No. 10,645,782, which is a continuation-in-part of application No. 16/547,502, filed on Aug. 21, 2019, now Pat. No. 10,485,073, which is a continuation-in-part of application No. 16/530,747, filed on Aug. 2, 2019, now Pat. No. 10,492,265, which is a continuation-in-part of application No. 16/458,823, filed on Jul. 1, 2019, now Pat. No. 10,485,065, which is a continuation-in-part of application No. 16/432,735, filed on Jun. 5, 2019, now Pat. No. 10,390,396, which is a continuation-in-part of application No. 16/401,849, filed on May 2, 2019, now Pat. No. 10,390,395, which is a continuation-in-part of application No. 16/296,864, filed on Mar. 8, 2019, now Pat. No. 10,390,394, which is a continuation-in-part of application No. 16/269,510, filed on Feb. 6, 2019, now Pat. No. 10,314,123, which is a continuation-in-part of application No. 16/247,456, filed on Jan. 14, 2019, now Pat. No. 10,327,298, which is a continuation-in-part of application No. 16/208,510, filed on Dec. 3, 2018, now Pat. No. 10,237,946, which is a continuation-in-part of application No. 16/154,707, filed on Oct. 8, 2018, now Pat. No. 10,225,905, which is a continuation-in-part of application No. 15/947,631, filed on Apr. 6, 2018, now Pat. No. 10,123,388, which is a continuation-in-part of application No. 15/911,086, filed on Mar. 3, 2018, now Pat. No. 10,136,483, which is a continuation-in-part of application No. 15/897,106, filed on Feb. 14, 2018, now Pat. No. 10,161,616, which is a continuation-in-part of application No. 15/874,752, filed on Jan. 18, 2018, now Pat. No. 10,036,515, which is a continuation-in-part of application No. 15/836,170, filed on Dec. 8, 2017, now Pat. No. 10,021,753, which is a continuation-in-part of application No. 15/649,392, filed on Jul. 13, 2017, now Pat. No. 9,986,619, which is a continuation-in-part of application No. 15/444,536, filed on Feb. 28, 2017, now Pat. No. 9,826,595, which is a continuation-in-part of application No. 15/362,772, filed on Nov. 28, 2016, now Pat. No. 9,967,927, which is a continuation-in-part of application No. 15/225,748, filed on Aug. 1, 2016, now Pat. No. 9,743,484, which is a continuation-in-part of application No. 14/818,041, filed on Aug. 4, 2015, now Pat. No. 9,420,663, which is a continuation-in-part of application No. 14/688,841, filed on Apr. 16, 2015, now Pat. No. 9,288,867, which is a continuation-in-part of application No. 14/465,174, filed on Aug. 21, 2014, now Pat. No. 9,277,603, which is a continuation-in-part of application No. 14/135,116, filed on Dec. 19, 2013, now Pat. No. 9,163,818, which is a continuation-in-part of application No. 13/525,249, filed on Jun. 15, 2012, now Pat. No. 8,749,167.

(A)

(B)

SOLID-STATE LIGHTING WITH REMOTE TESTS AND CONTROLS

CROSS-REFERENCE TO RELATED APPLICATIONS

The present disclosure is part of a continuation-in-part (CIP) application of U.S. patent application Ser. No. 16/880,375, filed 21 May 2020, which is part of CIP application of U.S. patent application Ser. No. 16/861,137, filed 28 Apr. 2020, which is part of CIP application of U.S. patent application Ser. No. 16/830,198, filed 25 Mar. 2020, which is part of CIP application of U.S. patent application Ser. No. 16/735,410, filed 6 Jan. 2020 and issued as U.S. Pat. No. 10,660,179 on 19 May 2020, which is part of CIP application of U.S. patent application Ser. No. 16/694,970, filed 25 Nov. 2019 and issued as U.S. Pat. No. 10,602,597 on 24 Mar. 2020, which is part of CIP application of U.S. patent application Ser. No. 16/681,740, filed 12 Nov. 2019, which is part of CIP application of U.S. patent application Ser. No. 16/664,034, filed 25 Oct. 2019 and issued as U.S. Pat. No. 10,660,184 on 19 May 2020, which is part of CIP application of U.S. patent application Ser. No. 16/572,040, filed 16 Sep. 2019 and issued as U.S. Pat. No. 10,645,782 on 5 May 2020, which is part of CIP application of U.S. patent application Ser. No. 16/547,502, filed 21 Aug. 2019 and issued as U.S. Pat. No. 10,485,073 on 19 Nov. 2019, which is part of CIP application of U.S. patent application Ser. No. 16/530,747, filed 2 Aug. 2019 and issued as U.S. Pat. No. 10,492,265 on 26 Nov. 2019, which is part of CIP application of U.S. patent application Ser. No. 16/458,823, filed 1 Jul. 2019 and issued as U.S. Pat. No. 10,485,065 on 10 Nov. 2019, which is part of CIP application of U.S. patent application Ser. No. 16/432,735, filed 5 Jun. 2019 and issued as U.S. Pat. No. 10,390,396 on 20 Aug. 2019, which is part of CIP application of U.S. patent application Ser. No. 16/401,849, filed 2 May 2019 and issued as U.S. Pat. No. 10,390,395 on 20 Aug. 2019, which is part of CIP application of U.S. patent application Ser. No. 16/296,864, filed 8 Mar. 2019 and issued as U.S. Pat. No. 10,390,394 on 20 Aug. 2019, which is part of CIP application of U.S. patent application Ser. No. 16/269,510, filed 6 Feb. 2019 and issued as U.S. Pat. No. 10,314,123 on 4 Jun. 2019, which is part of CIP application of U.S. patent application Ser. No. 16/247,456, filed 14 Jan. 2019 and issued as U.S. Pat. No. 10,327,298 on 18 June 2019, which is part of CIP application of U.S. patent application Ser. No. 16/208,510, filed 3 Dec. 2018 and issued as U.S. Pat. No. 10,237,946 on 19 Mar. 2019, which is part of CIP application of U.S. patent application Ser. No. 16/154,707, filed 8 Oct. 2018 and issued as U.S. Pat. No. 10,225,905 on 5 Mar. 2019, which is part of a CIP application of U.S. patent application Ser. No. 15/947,631, filed 6 Apr. 2018 and issued as U.S. Pat. No. 10,123,388 on 6 Nov. 2018, which is part of a CIP application of U.S. patent application Ser. No. 15/911,086, filed 3 Mar. 2018 and issued as U.S. Pat. No. 10,136,483 on 20 Nov. 2018, which is part of a CIP application of U.S. patent application Ser. No. 15/897,106, filed 14 Feb. 2018 and issued as U.S. Pat. No. 10,161,616 on 25 Dec. 2018, which is a CIP application of U.S. patent application Ser. No. 15/874,752, filed 18 Jan. 2018 and issued as U.S. Pat. No. 10,036,515 on 31 Jul. 2018, which is a CIP application of U.S. patent application Ser. No. 15/836,170, filed 8 Dec. 2017 and issued as U.S. Pat. No. 10,021,753 on 10 Jul. 2018, which is a CIP application of U.S. patent application of Ser. No. 15/649,392 filed 13 Jul. 2017 and issued as U.S. Pat. No. 9,986,619 on 29 May 2018, which is a CIP application of U.S. patent application Ser. No. 15/444,536, filed 28 Feb. 2017 and issued as U.S. Pat. No. 9,826,595 on 21 Nov. 2017, which is a CIP application of U.S. patent application Ser. No. 15/362,772, filed 28 Nov. 2016 and issued as U.S. Pat. No. 9,967,927 on 8 May 2018, which is a CIP application of U.S. patent application Ser. No. 15/225,748, filed 1 Aug. 2016 and issued as U.S. Pat. No. 9,743,484 on 22 Aug. 2017, which is a CIP application of U.S. patent application Ser. No. 14/818,041, filed 4 Aug. 2015 and issued as U.S. Pat. No. 9,420,663 on 16 Aug. 2016, which is a CIP application of U.S. patent application Ser. No. 14/688,841, filed 16 Apr. 2015 and issued as U.S. Pat. No. 9,288,867 on 15 Mar. 2016, which is a CIP application of U.S. patent application Ser. No. 14/465,174, filed 21 Aug. 2014 and issued as U.S. Pat. No. 9,277,603 on 1 Mar. 2016, which is a CIP application of U.S. patent application Ser. No. 14/135,116, filed 19 Dec. 2013 and issued as U.S. Pat. No. 9,163,818 on 20 Oct. 2015, which is a CIP application of U.S. patent application Ser. No. 13/525,249, filed 15 Jun. 2012 and issued as U.S. Pat. No. 8,749,167 on 10 Jun. 2014. Contents of the above-identified applications are incorporated herein by reference in their entirety.

BACKGROUND

Technical Field

The present disclosure relates to light-emitting diode (LED) luminaire controls and more particularly to an LED luminaire control system with remote tests and controls, which can initiate or terminate a battery discharging test on a regular luminaire coupled to the LED luminaire control system.

Description of the Related Art

Solid-state lighting from semiconductor LEDs has received much attention in general lighting applications today. Because of its potential for more energy savings, better environmental protection (with no hazardous materials used), higher efficiency, smaller size, and longer lifetime than conventional incandescent bulbs and fluorescent tubes, the LED-based solid-state lighting will be a mainstream for general lighting in the near future. Meanwhile, as LED technologies develop with the drive for energy efficiency and clean technologies worldwide, more families and organizations will adopt LED lighting for their illumination applications. In this trend, the potential safety concerns such as risk of electric shock and fire become especially important and need to be well addressed.

In today's retrofit applications of an LED lamp to replace an existing fluorescent lamp, consumers may choose either to adopt a ballast-compatible LED lamp with an existing ballast used to operate the fluorescent lamp or to employ an AC mains-operable LED lamp by removing/bypassing the ballast. Either application has its advantages and disadvantages. In the former case, although the ballast consumes extra power, it is straightforward to replace the fluorescent lamp without rewiring, which consumers have a first impression that it is the best alternative. But the fact is that total cost of ownership for this approach is high regardless of very low initial cost. For example, the ballast-compatible LED lamps work only with particular types of ballasts. If the existing ballast is not compatible with the ballast-compatible LED lamp, the consumer will have to replace the ballast. Some facilities built long time ago incorporate different types of fixtures, which requires extensive labor for both identifying ballasts and replacing incompatible ones. Moreover, the ballast-compatible LED lamp can operate longer than the ballast. When an old ballast fails, a new ballast will be needed to replace in order to keep the ballast-compatible LED lamps working. Maintenance will be complicated, sometimes for the lamps and sometimes for the ballasts. The incurred cost will preponderate over the initial cost savings by changeover to the ballast-compatible LED lamps for hundreds of fixtures throughout a facility. In addition, replacing a failed ballast requires a certified electrician. The labor costs and long-term maintenance costs will be unacceptable to end users. From energy saving point of view, a ballast constantly draws power, even when the ballast-compatible LED lamps are dead or not installed. In this sense, any energy saved while using the ballast-compatible LED lamps becomes meaningless with the constant energy use by the ballast. In the long run, the ballast-compatible LED lamps are more expensive and less efficient than self-sustaining AC mains-operable LED lamps.

On the contrary, an AC mains-operable LED lamp does not require a ballast to operate. Before use of the AC mains-operable LED lamp, the ballast in a fixture must be removed or bypassed. Removing or bypassing the ballast does not require an electrician and can be replaced by end users. Each AC mains-operable LED lamp is self-sustaining. Once installed, the AC mains-operable LED lamps will only need to be replaced after 50,000 hours. In view of above advantages and disadvantages of both the ballast-compatible LED lamps and the AC mains-operable LED lamps, it seems that market needs a most cost-effective solution by using a universal LED lamp that can be used with the AC mains and is compatible with a ballast so that LED lamp users can save an initial cost by changeover to such an LED lamp followed by retrofitting the lamp fixture to be used with the AC mains when the ballast dies.

Furthermore, the AC mains-operable LED lamps can easily be used with emergency lighting, which is especially important in this consumerism era. The emergency lighting systems in retail sales and assembly areas with an occupancy load of 100 or more are required by codes in many cities. Occupational Safety and Health Administration (OSHA) requires that a building's exit paths be properly and automatically lighted at least ninety minutes of illumination at a minimum of 10.8 lux so that an employee with normal vision can see along the exit route after the building power becomes unavailable. This means that emergency egress lighting must operate reliably and effectively during low visibility evacuations. To ensure reliability and effectiveness of backup lighting, building owners should abide by the National Fire Protection Association's (NFPA) emergency egress light requirements that emphasize performance, operation, power source, and testing. OSHA requires most commercial buildings to adhere to the NFPA standards or a significant fine. Meeting OSHA requirements takes time and investment, but not meeting them could result in fines and even prosecution. If a building has egress lighting problems that constitute code violations, the quickest way to fix is to replace existing lamps with multi-function LED lamps that have an emergency light package integrated with the normal lighting or to cascade the existing lamps with an LED luminaire control system that can reliably operate the existing lamps. The code also requires the emergency lights be inspected and tested to ensure they are in proper working conditions at all times. It is, therefore, the manufacturers' responsibility to design an LED luminaire control system that can work with a regular LED lamp, an LED luminaire, or an LED lighting system with minimum retrofitting efforts, that can enable an emergency operation using a battery backup system, and that can support auto-testing to meet regulatory requirements. Furthermore, the LED luminaire control system must have functionalities of remote tests and controls which can initiate or terminate a battery discharging test on the existing lamps without physically accessing LED luminaire control system.

SUMMARY

An LED luminaire control system comprises a rechargeable battery with a terminal voltage, a control and test circuit, and a current-fed converter circuit. The current-fed converter circuit is configured to receive power from the rechargeable battery and to generate a high direct current (DC) voltage operating an external power supply unit, subsequently powering up external one or more LED arrays when a line voltage from the AC mains is unavailable. The external power supply unit is originally configured to operate the external one or more LED arrays with a rated power by using the line voltage from the AC mains. By adopting the LED luminaire control system with a low-voltage conversion circuit to adapt a dimming signal, the external power supply unit can operate the one or more LED arrays at a fraction of the rated power without strobing.

The external power supply unit comprises at least two electrical conductors, a main full-wave rectifier, and a power switching converter. The at least two electrical conductors are configured to couple to the LED luminaire control system and to receive an input voltage. The main full-wave rectifier is coupled to the at least two electrical conductors and configured to convert the input voltage into a primary direct-current (DC) voltage. The power switching converter is configured to convert the primary DC voltage into a main DC voltage. The main DC voltage is configured to directly couple to the one or more LED arrays to operate thereof. The main full-wave rectifier may be further configured to guide an input DC current flow and to operate the power switching converter regardless of polarity of the high DC voltage associated with the input DC current.

The LED luminaire control system further comprises at least one full-wave rectifier and a battery charging circuit. The at least one full-wave rectifier is coupled to the AC mains and configured to convert the line voltage from the AC mains into a first DC voltage. The battery charging circuit comprises a first transformer, a first control device, a first electronic switch, a first diode, and a galvanic isolation circuit. The battery charging circuit is configured to be coupled to the at least one full-wave rectifier to convert the first DC voltage into a second DC voltage that charges the rechargeable battery to reach a terminal voltage. The galvanic isolation circuit is configured to couple the second DC voltage to the first control device in response to various charging voltage and current requirements. The galvanic isolation circuit comprises a shunt regulator and an opto-isolator circuit comprising an LED and a photo-transistor optically coupled to the LED. The LED is configured to monitor the second DC voltage through the shunt regulator whereas the photo-transistor is configured to send a signal to the first control device to turn the first electronic switch on and off, thereby regulating the second DC voltage and a charging current.

The current-fed converter circuit is configured to convert the terminal voltage into a third DC voltage (i.e. the high DC voltage mentioned above) when enabled. The LED luminaire control system further comprises a control and test circuit comprising a charging detection and control circuit.

The control and test circuit is configured to either enable and disable the current-fed converter circuit and to control either the line voltage from the AC mains or the third DC voltage from the current-fed converter circuit to the external power supply unit to operate according to availability of the AC mains and whether a battery discharging test is initiated.

The control and test circuit comprises a relay switch and is configured to enable and disable the current-fed converter circuit. The relay switch comprises a power sensing coil with a pick-up voltage and is configured to couple either the third DC voltage or the line voltage from the AC mains to the external power supply unit to operate thereon, subsequently powering up the external one or more LED arrays coupled with the external power supply unit. The relay switch further comprises a first input electrical terminal, a second input electrical terminal, and a pair of input electrical terminals. The first input electrical terminal is configured to couple to a hot wire of the line voltage from the AC mains whereas the second input electrical terminal is configured to couple to a high-potential lead wire of the third DC voltage. The pair of input electrical terminals are configured to receive the pick-up voltage to operate the power sensing coil. The relay switch further comprises an output electrical terminal configured to relay either the hot wire of the line voltage from the AC mains or the high-potential lead wire of the third DC voltage to the external power supply unit to operate thereon.

The control and test circuit may further comprise a low-voltage conversion circuit configured to regulate the external power supply unit to operate with a fraction of power consumed when the line voltage from the AC mains is available. The low-voltage conversion circuit is configured to tweak the dimming circuit in the external power supply unit and to maintain stability of the external power supply unit in a way that the external one or more LED arrays are operated with the fraction of power without strobing. The low-voltage conversion circuit comprises an electronic switch configured to pull down a dimming signal in the external power supply unit. The relay switch further comprises a single-pole double-throw (SPDT) configuration. The current-fed converter circuit further comprises a current return path configured for the third DC voltage to deliver power to the external power supply unit and to operate thereon.

The LED luminaire control system further comprises a receiver circuit comprising a receiver and a decoder, the receiver circuit coupled to the control and test circuit and configured to demodulate amplitude-shift keying (ASK) band-pass signals and to output a first pull-down signal. The LED luminaire control system further comprises a remote controller comprising a remote user interface and a transmitter circuit, the remote controller configured to send the ASK band-pass signals to the receiver circuit in response to one or more signals generated from the remote user interface. The control and test circuit may further comprise a local user interface and a control and test unit. The local user interface is configured to output a second pull-down signal whereas the control and test unit is configured to probe the second DC voltage, to control charging and discharging of the rechargeable battery, and to perform a battery discharging test.

The control and test unit is further configured to receive either the first pull-down signal or the second pull-down signal and to send a first control signal to the first control device to inactivate the battery charging circuit when the battery discharging test is initiated by either the remote user interface or the local user interface. The control and test circuit further comprises a first diode coupled between the receiver circuit and the control and test unit and configured to control a first current flowing direction of the first pull-down signal without interference from the second pull-down signal. The control and test circuit further comprises a second diode coupled between the local user interface and the control and test unit and configured to control a second current flowing direction of the second pull-down signal without interference from the first pull-down signal.

The control and test circuit further comprises a charging detection and control circuit. The charging detection and control circuit comprises a first transistor circuit configured to detect the second DC voltage. The charging detection and control circuit is coupled between the battery charging circuit and the rechargeable battery and controlled by the control and test unit. When the first transistor circuit detects the second DC voltage, the control and test unit enables a normal charging process, thereby allowing a charging current to flow into the rechargeable battery. The charging detection and control circuit further comprises a charging control circuit comprising a second transistor circuit and at least one metal-oxide-semiconductor field-effect transistor (MOSFET) circuit. The charging control circuit is configured to prohibit the charging current to flow into the rechargeable battery when the battery discharging test is initiated.

The second transistor circuit is configured to receive a high-level signal equal to a nominal operating voltage of the control and test unit to pull down a bias voltage of the at least one MOSFET circuit, thereby disconnecting the charging current when the battery discharging test is initiated. The control and test unit comprises a microcontroller, a microchip, or a programmable logic controller.

The remote controller further comprises an encoder coupled between the remote user interface and the transmitter circuit and configured to convert the one or more signals into one or more sets of binary data characters. Each of the one or more sets of binary data characters comprises command data. Each of the one or more sets of binary data characters further comprises a first bit string and a second bit string, respectively configured to set up starting bits and ending bits as a means of synchronizing the receiver circuit. The command data are inserted between the first bit string and the second bit string. Each of the one or more sets of binary data characters further comprises a separation bit string configured to signal that the starting bits, the command data, and the ending bits will resume after the separation bit string ends. The first bit string comprises a third bit string configured to accommodate identification data. The transmitter circuit further comprises a third transistor circuit and a fourth transistor circuit, respectively comprises a third transistor and a fourth transistor. Both the third transistor circuit and the fourth transistor circuit are configured to modulate the one or more sets of binary data characters onto a carrier wave with a designated frequency. The remote controller further comprises a surface-acoustic-wave (SAW) resonator stabilized at the designated frequency, the SAW resonator configured to couple to both the third transistor circuit and the fourth transistor circuit. When the remote user interface is triggered, the fourth transistor is enabled and disabled according to the one or more sets of binary data characters to turn the third transistor on and off, thereby modulating the one or more sets of binary data characters onto the carrier wave. The remote user interface comprises two or more push-button switches configured to provide the one or more signals. at least one of the one or more signals is configured to pair the decoder with the encoder in a way that the receiver circuit solely accepts the command data sent from the remote controller. At least one of the one or more signals is configured to cause the control and test unit to execute charging and discharging of the rechargeable battery and the battery discharging test. At least one of the one or more signals is configured to stop the control and test unit from performing the battery discharging test, thereby terminating the third DC voltage appeared at the high-potential lead wire to prevent users from electric shock.

In this disclosure, the LED luminaire control system may be adopted to couple to various LED luminaires such as high-power UFO lighting fixtures over 100 watts, sport lighting fixtures over 200 watts, low-power panel lights under 50 watts, LED lamps under 20 watts, etc. with the remote controller to control tests of charging and discharging of the rechargeable battery, supporting dual mode operations of such LED luminaires to work in a normal mode and in an emergency mode.

BRIEF DESCRIPTION OF THE DRAWINGS

Non-limiting and non-exhaustive embodiments of the present disclosure are described with reference to the following figures, wherein like reference numerals refer to like parts throughout the various figures unless otherwise specified. Moreover, in the section of detailed description of the invention, any of a "main", a "first", a "second", a "third", and so forth does not necessarily represent a part that is mentioned in an ordinal manner, but a particular one.

DETAILED DESCRIPTION OF THE INVENTION

Figure 1:
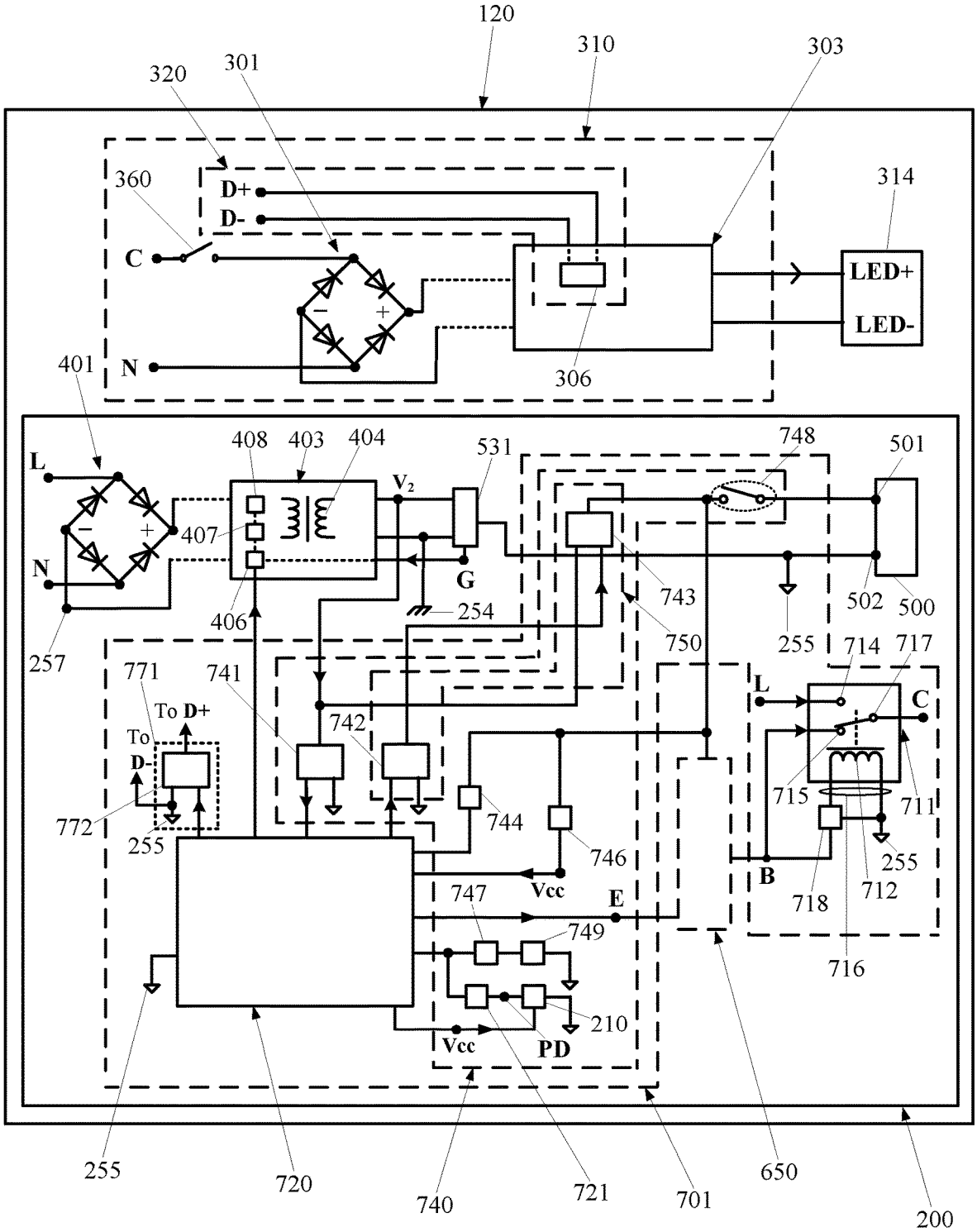
FIG. 1 is a block diagram of an LED luminaire control system according to the present disclosure.

FIG. 1 is a block diagram of an LED luminaire control system according to the present disclosure. In FIG. 1, the integrated LED luminaire 120 comprises one or more LED arrays 314, a power supply unit 310, and an LED luminaire control system 200. The LED luminaire control system 200 comprises a current-fed converter circuit 650 configured to provide an emergency power (a voltage and a current) to drive the power supply unit 310 (the external power supply unit 310, hereinafter), subsequently driving the one or more LED arrays 314 (the external one or more LED arrays 314, hereinafter) when the line voltage from the AC mains is unavailable. The external power supply unit 310 originally designed to receive the line voltage from the AC mains for general lighting applications is configured to operate in the normal mode. The external power supply unit 310 comprises an input operating voltage range such as 100-347 volts (AC or DC). The external power supply unit 310 comprises two electrical conductors "C" and "N", a main full-wave rectifier 301, and a power switching converter 303. The main full-wave rectifier 301 is coupled to the electrical conductor "C" via a power switch 360. The main full-wave rectifier 301 is configured to convert the line voltage from the AC mains into a primary DC voltage. The power switching converter 303 may comprise a controller 320 comprising a dimming circuit 306 and a pair of input ports denoted as "D+D−" configured to receive a 0-to-10 V signal, a 1-to-10 V signal, a dimming signal, a PWM signal, or a signal from a variable resistor for luminaire dimming applications. The power switching converter 303 is a current source, providing an LED driving current to the external one or more LED arrays 314 to operate thereon. In some applications such as a low-power single LED lamp operation, the power switching converter 303 may not comprise the controller 320.

In FIG. 1, the LED luminaire control system 200 further comprises the at least two electrical conductors "L" and "N" configured to couple to the AC mains, a rechargeable battery 500, at least one full-wave rectifier 401, a battery charging circuit 403, and a control and test circuit 701. The at least one full-wave rectifier 401 is coupled to the at least two electrical conductors "L" and "N" and configured to convert the line voltage from the AC mains into a first DC voltage. The rechargeable battery 500 comprises a high-potential electrode 501 and a low-potential electrode 502 with a terminal voltage across thereon. The battery charging circuit 403 is an isolated step-down converter and comprises a first transformer 404, a galvanic isolation circuit 531, a first control device 406, a first electronic switch 407, and a diode 408. The battery charging circuit 403 is coupled to the at least one full-wave rectifier 401 and configured to convert the first DC voltage into a second DC voltage that charges the rechargeable battery 500 to reach the terminal voltage. The galvanic isolation circuit 531, a part of a control loop, is configured to monitor the second DC voltage and to regulate the first control device 406 in response to various charging voltage and current requirements. That is, when the second DC voltage and an associated current fluctuate due to charging condition changes, the galvanic isolation circuit 531 feedbacks a signal to the first control device 406 to rapidly adjust the second DC voltage and the associated current for stabilization. In addition, when a rated terminal voltage is reached, the galvanic isolation circuit 531 feedbacks another signal to the first control device 406 to reduce a charging current to avoid overcharging. In FIG. 1, the control and test circuit 701 further comprises a control and test unit 720 and a charging detection and control circuit 740. The control and test circuit 701 is configured to either enable or disable the current-fed converter circuit 650 via a port denoted as "E" according to availability of the AC mains and whether a battery discharging test is initiated. In other words, the current-fed converter circuit 650 is configured to convert the terminal voltage into a third DC voltage high enough to operate the external power supply unit 310 when enabled. The charging detection and control circuit 740 comprises a first transistor circuit 741 configured to detect a charging voltage (i.e. the second DC voltage) generated from the battery charging circuit 403.

Figure 2:
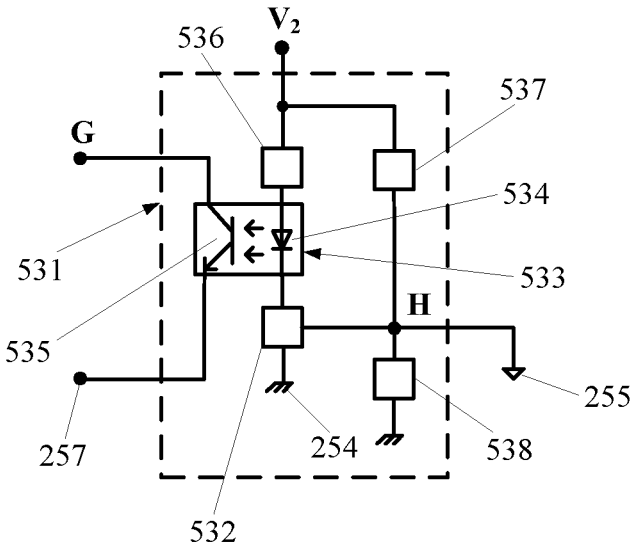
FIG. 2 is a block diagram of a galvanic isolation circuit according to the present disclosure.

FIG. 2 is a block diagram of a galvanic isolation circuit according to the present disclosure. In FIG. 2, the galvanic isolation circuit 531 comprises a shunt regulator 532 and an opto-isolator circuit 533 comprising an LED 534 and a photo-transistor 535 optically coupled to the LED 534. The LED 534 is configured to monitor the second DC voltage ($V_2$) through the shunt regulator 532 whereas the photo-transistor 535 is configured to send a signal to the first control device 406 to turn the first electronic switch 407 on and off, thereby regulating the second DC voltage and the charging current. The galvanic isolation circuit 531 further comprises bias resistors 536 and 537 and a sensing resistor 538. The shunt regulator 532, a three-terminal device, comprises an adjustable reference with the sensing resistor 538 connected to regulate a current flowing into the LED 534, further controlling the photo-transistor 535 whose output port "G" is coupled to the first control device 406 (FIG. 1) with respect to a voltage reference 257 coupled to a negative potential port 257 (FIG. 1) of the at least one full-wave rectifier 401. The sensing resistor 538 is further configured to couple between a first ground reference 254 and a second ground reference 255, which is coupled to a common ground (i.e. the second ground reference 255) of the current-fed converter circuit 650. In other words, the sensing resistor 538 and the second ground reference 255 provide a common current return path for the third DC voltage from the current-fed converter circuit 650 to deliver power to the external power supply unit 310 and to operate thereon.

Back in FIG. 1, the control and test circuit 701 further comprises a relay switch 711 and is configured to enable and disable the current-fed converter circuit 650. The relay switch 711 comprises a power sensing coil 712 with a pick-up voltage and a drop-out voltage and is configured to couple either the third DC voltage or the line voltage from the AC mains to the external power supply unit 310 to operate thereon, subsequently powering up the external one or more LED arrays 314 coupled with the external power supply unit 310. The relay switch 711 further comprises a first input electrical terminal 714, a second input electrical terminal 715, and a pair of input electrical terminals 716. The first input electrical terminal 714 is configured to couple to a hot wire "L" of the line voltage from the AC mains whereas the second input electrical terminal 715 is configured to couple to the third DC voltage via the port "B". The pair of input electrical terminals 716 are configured to receive the pick-up voltage to operate the power sensing coil 712. The relay switch 711 further comprises an output electrical terminal 717 configured to relay either the hot wire of the line voltage from the AC mains or the third DC voltage to the external power supply unit 310 to operate thereon. The control and test circuit 701 further comprises a voltage regulator 718 coupled to the power sensing coil 712 whereas the voltage regulator 718 is configured to regulate the pickup voltage applied to the power sensing coil 712. When the current-fed converter circuit 650 is enabled, the pick-up voltage is built up for the power sensing coil 712 to operate. The relay switch 711 further comprises a single-pole double-throw (SPDT) configuration, which accommodates only a current flow to the external power supply unit 310. The current-fed converter circuit 650 further comprises a current return path such as the second ground reference 255. Such a current return path is thus configured for the third DC voltage to deliver power to the external power supply unit 310 and to operate thereon.

In FIG. 1, the charging detection and control circuit 740 further comprises a first peripheral circuit 744. The first peripheral circuit 744 is configured to sample a fraction of the terminal voltage on the rechargeable battery 500 and to deliver to the control and test unit 720 to examine when the battery discharging test is initiated. The charging detection and control circuit 740 further comprises a linear voltage regulator 746 configured to regulate the terminal voltage to an operating voltage of the control and test unit 720 to operate thereof.

The control and test unit 720 is further configured to receive a pull-up signal from the first transistor circuit 741 and to send a first control signal to the first control device 406 to inactivate the battery charging circuit 403 when the battery discharging test is initiated. The charging detection and control circuit 740 is coupled between the battery charging circuit 403 and the rechargeable battery 500 and controlled by the control and test unit 720. When the first transistor circuit 741 detects the charging voltage, a pull-down signal is sent to the control and test unit 720 to enable a normal charging process. The charging detection and control circuit 740 further comprises a charging control circuit 750 comprising a second transistor circuit 742 and at least one MOSFET circuit 743. The charging control circuit 750 is configured to allow a charging current to flow into the rechargeable battery 500 when the line voltage from the AC mains is available whereas the charging control circuit 750 prohibits the charging current to flow into the rechargeable battery 500 when the battery discharging test is initiated. The second transistor circuit 742 is configured to receive a high-level signal approximately equal to an operating voltage of the control and test unit 720 therefrom to pull down a bias voltage of the at least one MOSFET circuit 743, thereby disconnecting the charging current when the battery discharging test is initiated.

The charging detection and control circuit 740 further comprises at least one pair of electrical contacts 748 configured to electrically couple the rechargeable battery 500 to the battery charging circuit 403, the current-fed converter circuit 650, and the control and test unit 720 when the at least one pair of electrical contacts 748 are connected. When the battery discharging test is initiated or when the line voltage from the AC mains is unavailable, power from the rechargeable battery 500 can operate the current-fed converter circuit 650 and the control and test unit 720. On the other hand, when disconnected, the at least one pair of electrical contacts 748 can safely prevent the rechargeable battery 500 from being drained. The at least one pair of electrical contacts 748 comprise electrical contacts in a switch, a relay, and a jumper, or electrical terminals accommodated for jumper wires. The charging detection and control circuit 740 further comprises a local user interface 749 coupled to the control and test unit 720 and is configured to manually have the control and test unit 720 initiate the battery discharging test. The local user interface 749 may be further configured to manually have the control and test unit 720 terminate the battery discharging test that is in progress. In FIG. 1, the control and test circuit 701 may further comprise a low-voltage conversion circuit 771 configured to regulate the external power supply unit 310 to operate with a fraction of power consumed when the line voltage from the AC mains is available. The low-voltage conversion circuit 771 is configured to auto-adjust the dimming signal in the external power supply unit 310 from a voltage level of 10 volts to a nominal voltage of 1 volt. The process ensures that output power equals input power so as to maintain stability of the external power supply unit 310 in a way that the external one or more LED arrays 314 are operated with the fraction of power without strobing. The low-voltage conversion circuit 771 comprises a fourth electronic switch 772 configured to pull down the dimming signal in the external power supply unit 310. The control and test unit 720 may comprise a microcontroller, a microchip, or a programmable logic controller.

Figure 3:
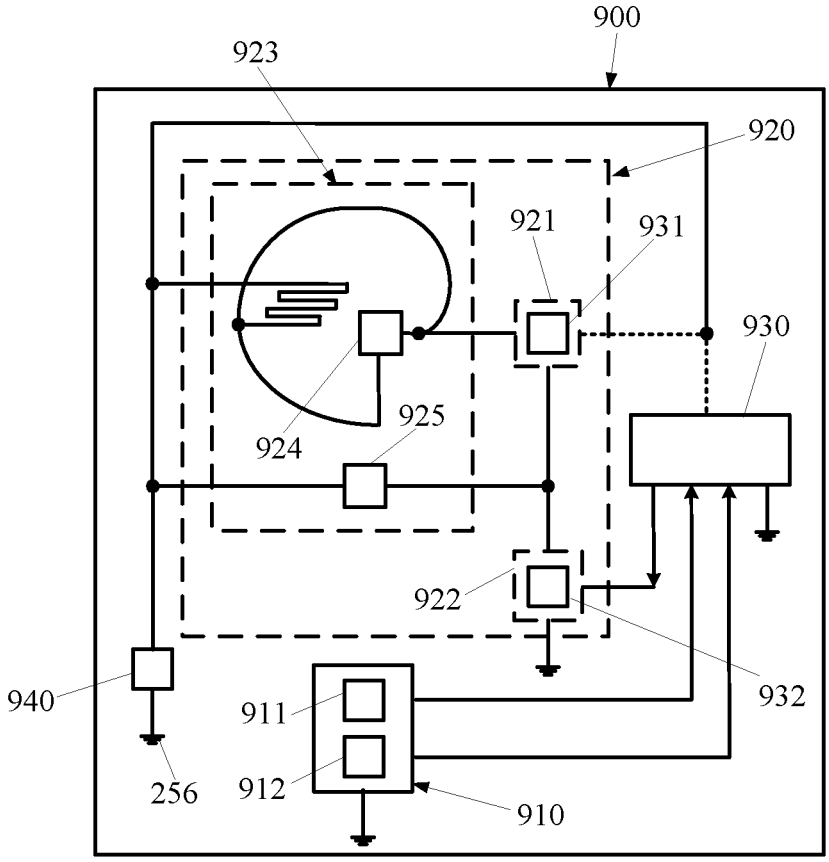
FIG. 3 is a block diagram of a remote controller according to the present disclosure.

FIG. 3 is a block diagram of a remote controller according to the present disclosure. The remote controller 900 comprises a remote user interface 910 and a transmitter circuit 920. The remote controller 900 is configured to send an amplitude-shift keying (ASK) band-pass signals to a receiver circuit (FIG. 4) in response to one or more signals generated from the remote user interface 910. The remote controller 900 further comprises an encoder 930 coupled between the remote user interface 910 and the transmitter circuit 920 and configured to convert the one or more signals into one or more sets of binary data characters. Each of the one or more sets of binary data characters comprises command data. The remote controller 900 is powered by a battery 940. The transmitter circuit 920 further comprises a third transistor circuit 921 and a fourth transistor circuit 922. Each of the third transistor circuit 921 and the fourth transistor circuit 922 respectively comprises a third transistor 931 and a fourth transistor 932. Both the third transistor circuit 921 and the fourth transistor circuit 922 are configured to modulate the one or more sets of binary data characters onto a carrier wave with a designated frequency. The remote controller 900 further comprises a surface-acoustic-wave (SAW) resonator 923 stabilized at the designated frequency. The SAW resonator 923 is configured to couple to both the third transistor circuit 921 and the fourth transistor circuit 922. When the remote user interface 910 is triggered, the fourth transistor 932 is enabled and disabled according to the one or more sets of binary data characters to turn the third transistor 931 on and off, thereby modulating the one or more sets of binary data characters onto the carrier wave. The remote user interface 910 comprises two or more push-button switches 911 and 912 configured to provide the one or more signals by pressing one of the two or more push-button switches 911 and 912 one time, by pressing both the two or more push-button switches 911 and 912 at the same time, or by pressing one of the two or more push-button switches 911 and 912 two times, etc. The SAW resonator 923 further comprises a capacitor 924 and a crystal oscillator 925, both configured to work with both the third transistor circuit 921 and the fourth transistor circuit 922 and to provide the ASK band-pass signals. The remote controller 900 further comprises a remote ground reference 256.

Figure 4:
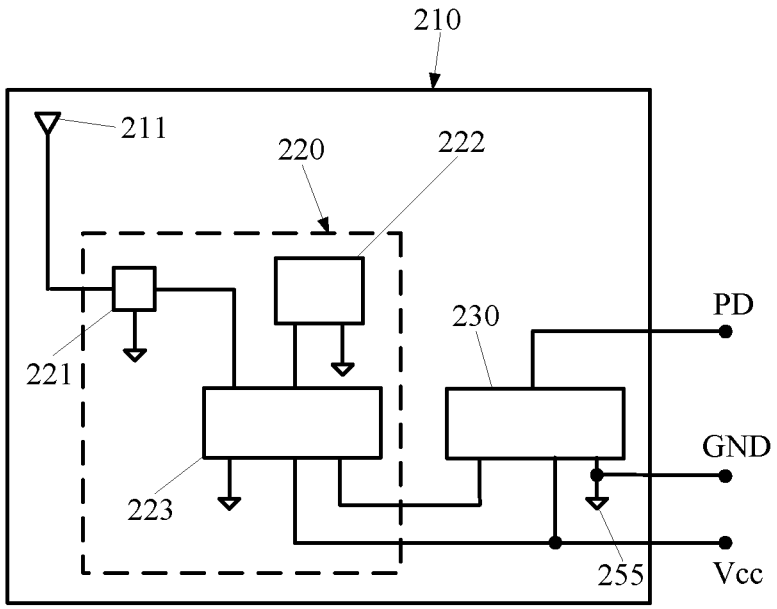
FIG. 4 is a block diagram of a receiver circuit according to the present disclosure.

FIG. 4 is a block diagram of a receiver circuit according to the present disclosure. The receiver circuit 210 comprises an antenna 211, a receiver 220, and a decoder 230. The receiver circuit 210 is coupled to the control and test circuit 740 via a pull-down (PD) port and configured to demodulate the ASK band-pass signals and to output a first pull-down signal. The receiver 220 comprises a matching network 221 coupled to the antenna 211, a reference crystal oscillator 222, and a receiver controller 223. The receiver 220 is coupled to the decoder 230 and configured to provide on-off keying (OOK) signals for the decoder 230 to extract the command data in the one or more sets of binary data characters transmitted from the remote controller 900. Depending on the command data, the decoder 230 may choose to code-match the encoder 930 in a way that the receiver circuit 210 solely accepts the command data sent from the remote controller 900. That is, at least one of the one or more signals from the remote user interface 910 is configured to pair the decoder 230 with the encoder 930. The decoder 230 may choose to have the control and test unit 720 execute charging and discharging of the rechargeable battery 500 and the battery discharging test. That is, at least one of the one or more signals from the remote user interface 910 is configured to execute charging and discharging of the rechargeable battery 500 and the battery discharging test. The decoder 230 may choose to stop the control and test unit 720 from performing the battery discharging test, thereby terminating the third DC voltage appeared at the high-potential lead wire to prevent users from electric shock. That is, at least one of the one or more signals from the remote user interface 910 is configured to stop the control and test unit 720 from performing the battery discharging test. When the command data are to execute charging and discharging of the rechargeable battery 500 and the battery discharging test, the decoder 230 send a pull-down (PD) signal out to the control and test unit 720.

Back in FIG. 1, the local user interface 749 is configured to output a second pull-down signal. The control and test circuit 740 further comprises a first diode 721 coupled between the control and test unit 720 and the receiver circuit 210 via a port "PD" and configured to control current flowing of the first pull-down signal without interference from the second pull-down signal. As mentioned above, the control and test unit 720 is configured to probe the second DC voltage, to control charging and discharging of the rechargeable battery 500, and to perform a battery discharging test. The control and test circuit 740 further comprises a second diode 747 coupled between the local user interface 749 and the control and test unit 720 and configured to control current flowing of the second pull-down signal without interference from the first pull-down signal.

Figure 5:
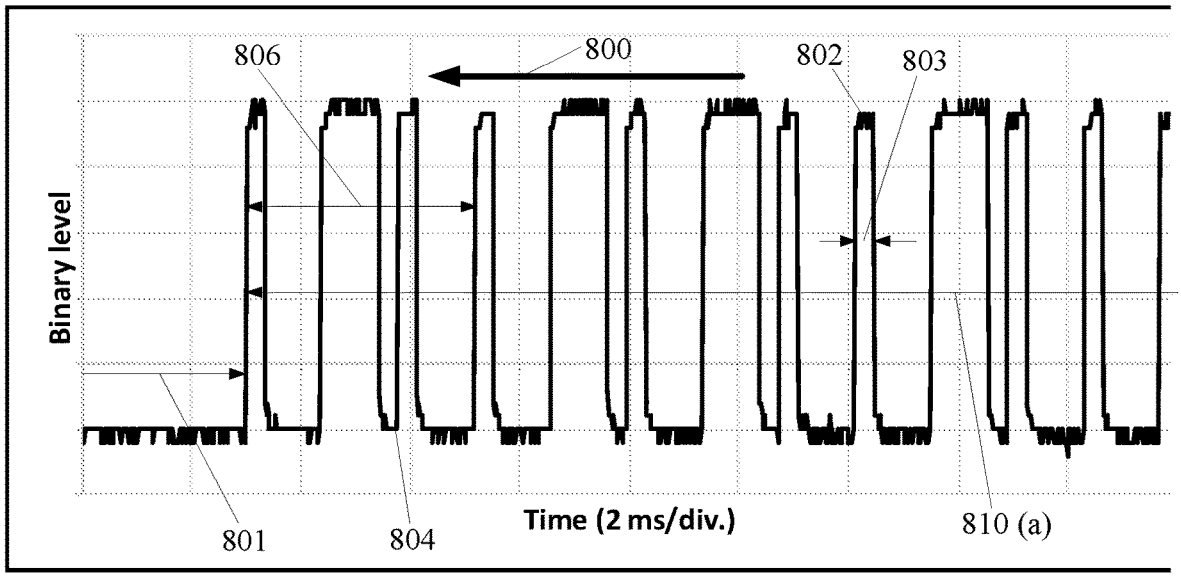
FIG. 5 is an example of one of one or more sets of binary data characters according to the present disclosure.
Figure 5:
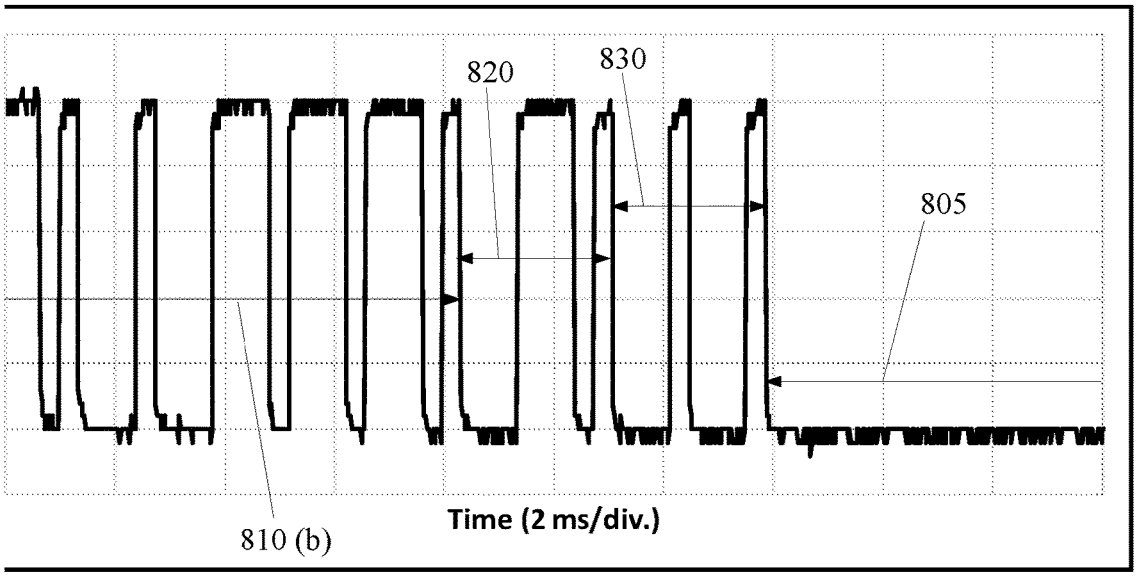

FIG. 5 is an example of one of one or more sets of binary data characters according to the present disclosure. FIG. 5 comprises two parts (A) and (B) with the leftmost open side of the part (B) connected to the rightmost open side of the part (A). The example is for demonstration only, with an arbitrary number of character bits, an arbitrary number of binary "1" bits, and an arbitrary number of binary "0" bits. In FIG. 5, a data transfer direction 800 is as shown against elapsed time from left to right. One of one or more sets of binary data characters comprises a separation bit string 801 and a burst of regularly spaced binary data bits, the binary "1" bits and the binary "0" bits, following the separation bit string 801, after which a flow of the regularly spaced binary data bits resumes. In FIG. 5, a high binary level 802 represents a binary "1" with a bit duration 803 whereas a low binary level 804 represents a binary "0". The burst of regularly spaced binary data bits comprises a first bit string 810(*a*) in the part (A) and 810(*b*) in the part (B) and a second bit string 830, respectively configured to set up starting bits and ending bits as a means of synchronizing the burst of regularly spaced binary data bits. The starting bits and ending bits are essential for the receiving circuit 210 to know when the burst of regularly spaced binary data bits begins, how much time elapses between bits, etc. When this timing information is known, the receiver circuit 210 (in FIG. 4) is said to be synchronized with the transmitter circuit 920 in FIG. 3), and an accurate data transfer becomes possible. The command data 820 are inserted between the first bit string 810(*a*) and 810(*b*) and the second bit string 830. After the second bit string 830, another separation hit string 805 is followed, like the separation bit string 801. Either the separation bit string 801 or 805 is configured to signal that the starting bits, the command data, and the ending bits will resume after either the separation bit string 801 or 805 ends. Depending on a code design, the first bit string 810(*a*) and 810(*b*) may comprise a third bit string configured to accommodate an identification data 806.

Whereas preferred embodiments of the present disclosure have been shown and described, it will be realized that alterations, modifications, and improvements may be made thereto without departing from the scope of the following claims. Another kind of schemes with an LED luminaire control system that incorporates remote controls for emergency tests or various kinds of combinations adopted to operate an LED luminaire to accomplish the same or different objectives could be easily adapted for use from the present disclosure. Accordingly, the foregoing descriptions and attached drawings are by way of example only and are not intended to be limiting.

What is claimed is:

1. A light-emitting diode (LED) luminaire control system, comprising:

a rechargeable battery comprising a high-potential electrode and a low-potential electrode with a terminal voltage across thereon;

at least one full-wave rectifier configured to be coupled to alternate-current (AC) mains to convert a line voltage from the AC mains into a first direct-current (DC) voltage;

a battery charging circuit comprising a first control device, a first electronic switch, and a galvanic isolation circuit, wherein the battery charging circuit is coupled to the at least one full-wave rectifier to convert the first DC voltage into a second DC voltage that charges the rechargeable battery to reach the terminal voltage, and wherein the galvanic isolation circuit is configured to couple the second DC voltage to the first control device in response to various charging voltage and current requirements;

a current-fed converter circuit configured to convert the terminal voltage into a third DC voltage when enabled;

a control and test circuit comprising a relay switch, wherein the control and test circuit is configured to enable and disable the current-fed converter circuit, and wherein the relay switch comprises a power sensing coil with a pick-up voltage and is configured to couple either the third DC voltage or the line voltage from the AC mains to an external power supply unit to operate thereon, subsequently powering up external one or more LED arrays coupled with the external power supply unit; and a receiver circuit comprising a receiver and a decoder, the receiver circuit coupled to the control and test circuit and configured to demodulate amplitude-shift keying (ASK) band-pass signals and to output a first pull-down signal, wherein:

the relay switch further comprises a first input electrical terminal, a second input electrical terminal, and a pair of input electrical terminals, wherein the first input electrical terminal is configured to couple to a hot wire of the line voltage from the AC mains, wherein the second input electrical terminal is configured to couple to a high-potential lead wire of the third DC voltage, and wherein the pair of input electrical terminals are configured to receive the pick-up voltage to operate the power sensing coil; and the relay switch further comprises an output electrical terminal configured to relay either the hot wire of the line voltage from the AC mains or the high-potential lead wire of the third DC voltage to the external power supply unit to operate thereon.

2. The LED luminaire control system of claim 1, wherein the control and test circuit further comprises a local user interface and a control and test unit, wherein the local user interface is configured to output a second pull-down signal, and wherein the control and test unit is configured to probe the second DC voltage, to control charging and discharging of the rechargeable battery, and to perform a battery discharging test.

3. The LED luminaire control system of claim 2, wherein the control and test unit is further configured to receive either the first pull-down signal or the second pull-down signal and to send a first control signal to the first control device to inactivate the battery charging circuit when the battery discharging test is initiated by either a remote controller or the local user interface.

4. The LED luminaire control system of claim 2, wherein the control and test circuit further comprises a first diode coupled between the receiver circuit and the control and test unit and configured to control a first current flowing direction of the first pull-down signal without interference from the second pull-down signal.

5. The LED luminaire control system of claim 2, wherein the control and test circuit further comprises a second diode coupled between the local user interface and the control and test unit and configured to control a second current flowing direction of the second pull-down signal without interference from the first pull-down signal.

6. The LED luminaire control system of claim 2, wherein the control and test circuit further comprises a charging detection and control circuit, wherein the charging detection and control circuit comprises a first transistor circuit configured to detect the second DC voltage, wherein the charging detection and control circuit is coupled between the battery charging circuit and the rechargeable battery and controlled by the control and test unit, and wherein, when the first transistor circuit detects the second DC voltage, the control and test unit enables a normal charging process, thereby allowing a charging current to flow into the rechargeable battery.

7. The LED luminaire control system of claim 6, wherein the charging detection and control circuit further comprises a charging control circuit comprising a second transistor circuit and at least one metal-oxide-semiconductor field-effect transistor (MOSFET) circuit, and wherein the charging control circuit is configured to prohibit the charging current to flow into the rechargeable battery when the battery discharging test is initiated.

8. The LED luminaire control system of claim 7, wherein the second transistor circuit is configured to receive a signal equal to a nominal operating voltage of the control and test unit to pull down a bias voltage of the at least one MOSFET circuit, thereby disconnecting the charging current when the battery discharging test is initiated.

9. The LED luminaire control system of claim 1, wherein the control and test circuit further comprises a voltage regulator coupled to the power sensing coil, wherein the voltage regulator is configured to regulate the pick-up voltage applied to the power sensing coil, and wherein, when the current-fed converter circuit is enabled, the pick-up voltage is built up for the power sensing coil to operate.

10. The LED luminaire control system of claim 2, wherein the control and test unit comprises a microcontroller, a microchip, or a programmable logic controller.

11. The LED luminaire control system of claim 1, further comprising a remote controller comprising a remote user interface and a transmitter circuit, the remote controller configured to send the ASK band-pass signals to the receiver circuit in response to one or more signals generated from the remote user interface, wherein the remote controller further comprises an encoder coupled between the remote user interface and the transmitter circuit and configured to convert the one or more signals into one or more sets of binary data characters, and wherein each of the one or more sets of binary data characters comprises command data.

12. The LED luminaire control system of claim 11, wherein each of the one or more sets of binary data characters further comprises a first bit string and a second bit string, respectively configured to set up starting bits and ending bits as a means of synchronizing the receiver circuit, and wherein the command data are inserted between the first bit string and the second bit string.

13. The LED luminaire control system of claim 12, wherein each of the one or more sets of binary data characters further comprises a separation bit string configured to signal that the starting bits, the command data, and the ending bits will resume after the separation bit string ends.

14. The LED luminaire control system of claim 12, wherein the first bit string comprises a third bit string configured to accommodate identification data.

15. The LED luminaire control system of claim 11, wherein the transmitter circuit further comprises a third transistor circuit and a fourth transistor circuit, wherein each of the third transistor circuit and the fourth transistor circuit respectively comprises a third transistor and a fourth transistor, and wherein both the third transistor circuit and the fourth transistor circuit are configured to modulate the one or more sets of binary data characters onto a carrier wave with a designated frequency.

16. The LED luminaire control system of claim 15, wherein the remote controller further comprises a surface-acoustic-wave (SAW) resonator stabilized at the designated frequency, the SAW resonator configured to couple to both the third transistor circuit and the fourth transistor circuit, and wherein, when the remote user interface is triggered, the fourth transistor is enabled and disabled according to the one or more sets of binary data characters to turn the third transistor on and off, thereby modulating the one or more sets of binary data characters onto the carrier wave.

17. The LED luminaire control system of claim 11, wherein the remote user interface comprises two or more push-button switches configured to provide the one or more signals.

18. The LED luminaire control system of claim 11, wherein at least one of the one or more signals is configured to pair the decoder with the encoder in a way that the receiver circuit solely accepts the command data sent from the remote controller.

19. The LED luminaire control system of claim 2, wherein at least one of the one or more signals is configured to cause the control and test unit to execute charging and discharging of the rechargeable battery and the battery discharging test.

20. The LED luminaire control system of claim 2, wherein at least one of the one or more signals is configured to stop the control and test unit from performing the battery discharging test, thereby terminating the third DC voltage appeared at the high-potential lead wire to prevent users from electric shock.

* * * * *